US006145589A

United States Patent [19]

Gowan

[11] Patent Number: 6,145,589

[45] **Date of Patent: *Nov. 14, 2000**

[54] MANIFOLD FOR HEAT EXCHANGER AND BAFFLES THEREFOR

[75] Inventor: James D. Gowan, Montgomery, Ala.

[73] Assignee: Thermal Components a division of Insilco Corporation, Montgomery, Ala.

[ * ] Notice: This patent is subject to a terminal disclaimer.

[21] Appl. No.: 09/265,569

[22] Filed: Mar. 10, 1999

Related U.S. Application Data

[63] Continuation of application No. 08/896,767, Jul. 18, 1997, Pat. No. 6,056,047, which is a continuation-in-part of application No. 08/842,041, Apr. 23, 1997, Pat. No. 5,934,366.

[51] Int. Cl.[7] ..... F28F 9/22

[52] U.S. Cl. ..... 165/174; 165/153; 165/173

[58] Field of Search ..... 165/173, 174, 165/176, 153

[56] References Cited

U.S. PATENT DOCUMENTS

| | | | |
|---|---|---|---|
| 4,150,556 | 4/1979 | Melnyk . | |
| 4,960,169 | 10/1990 | Granetzke . | |
| 5,022,465 | 6/1991 | Baines . | |
| 5,052,480 | 10/1991 | Nakajima et al. . | |
| 5,097,900 | 3/1992 | Yamaguchi | 165/174 |
| 5,119,552 | 6/1992 | Sutou et al. . | |
| 5,123,483 | 6/1992 | Yokutake et al. | 165/176 |
| 5,183,107 | 2/1993 | Le Gauyer . | |
| 5,297,624 | 3/1994 | Haussman et al. . | |
| 5,329,990 | 7/1994 | Chigira . | |
| 5,348,083 | 9/1994 | Hosoya et al. . | |
| 5,586,600 | 12/1996 | Cribari . | |
| 5,622,220 | 4/1997 | Park et al. . | |
| 5,782,295 | 7/1998 | Kato et al. | 165/174 |
| 5,881,456 | 3/1999 | Bergins et al. | 165/153 X |
| 5,934,366 | 8/1999 | Gowan | 165/174 |
| 6,056,047 | 5/2000 | Gowan | 165/174 |

FOREIGN PATENT DOCUMENTS

| | | | |
|---|---|---|---|
| 0 754 520 | 1/1997 | European Pat. Off. . | |
| 2 681 421 | 3/1993 | France . | |
| 1 961 218 | 7/1970 | Germany . | |
| 40 31 576 | 4/1992 | Germany . | |
| 195 15 420 | 10/1996 | Germany | 165/173 |
| 254 931 | 7/1926 | United Kingdom . | |
| 2 090 652 | 7/1982 | United Kingdom . | |

*Primary Examiner*—Leonard Leo
*Attorney, Agent, or Firm*—Jacobson, Price, Holman & Stern, PLLC

[57] ABSTRACT

A manifold for heat exchangers with a manifold segment having slots which are perpendicular to the tube axis and spaced in the longitudinal direction and separated by webs, into which hollow flat tubes can be inserted and joined to the contact surface of the respective slot. The webs each have a pair of stampings to strengthen the material on each side of each web and the webs are relatively flat in shape such that the cross-section of the manifold segment has a generally D-shaped profile. At least one baffle is inserted in the manifold segment, centered between a pair of adjacent slots. The baffle has a principle circular edge and a truncated edge so as to have a truncated circular profile substantially corresponding to the approximately D-shaped profile of the manifold segment. The baffle also has an outwardly extending lip over a portion of its perimeter at the principle circular edge, the lip having projections extending from its ends, the projections being dimensioned to provide an interference fit between the baffle and the manifold segment. Circular edge of the baffle has a first radius $R_1$ which is less than the second radius $R_2$ of the truncated edge.

11 Claims, 5 Drawing Sheets

MANIFOLD FOR HEAT EXCHANGER AND BAFFLES THEREFOR

CROSS-REFERENCE TO RELATED APPLICATIONS

The present patent application is a continuation of U.S. application Ser. No. 08/896,767, filed Jul. 18, 1997, now U.S. Pat. No. 6,056,047, which is a continuation-in-part of U.S. application Ser. No. 08/842,041, filed Apr. 23, 1997, now U.S. Pat. No. 5,934,366, both of which are incorporated herein by reference in their entirety.

BACKGROUND OF THE INVENTION

1. Field of the Invention

The present invention relates generally to a manifold or header tube for heat exchangers. More specifically, the invention relates to manifolds having a D-shaped profile, and incorporating baffles, end caps, and brackets adapted to the D-shaped profile.

2. Related Art

In known types of tubular headers or manifolds for heat exchangers, at least one baffle is inserted into the manifold to divide the tube into compartments, and the tubular manifold wall is deformed inwardly on each side of the baffles after their introduction in order to secure them in place prior to brazing. Such manifolds and their method of manufacture are disclosed in U.S. Pat. No. 5,233,756 to le Gauyer. Manifolds made in accordance with the method of le Gauyer have substantially circular cross-sections, even after deformation to secure the baffles, and after formation of the tube slots which receive the head exchanger tubes. The deformation of the tubular wall to secure the baffles requires an extra manufacturing step. Further, the dome shaped webs of material between the tube slots have poor strength in their transition to the cylindrical surface of the manifold.

The manifold disclosed in the le Gauyer patent has a generally circular cross-section along its entire length. Although a circular cross-section is preferable from the perspective of overall strength, a generally D-shaped cross-section may be preferable for other reasons. For example, it is easier to form a joint between the manifold and the heat exchanger tubes on a generally planar surface, as found in a manifold of generally D-shaped cross-section, than around an arc as is found in a manifold of circular cross-section. Also, it is easier to assembly the heat exchanger tubes on a generally planar surface than on an arc. However, poor web strength remains a problem in manifolds of generally D-shaped cross-section, as it is in manifolds of generally circular cross-section.

The problem of poor web strength in manifolds of generally D-shaped cross-section is addressed in co-pending U.S. application Ser. No. 08/821,163, filed Mar. 20, 1997 entitled "Header Tubes for Heat Exchangers and the Methods Used for Their Manufacture" (Michael E. Bergins, inventor; attorney docket 18466.081), which is incorporated herein by reference in its entirety. In the manifolds disclosed in U.S. application Ser. No. 08/821,163, the strength of the material is increased by stamping each side of each web with a stamping die. Furthermore, the webs are flattened such that the cross-section of the manifold segment has a D-shaped profile. However, U.S. application Ser. No. 08/821,163 does not address the problem of inserting baffles into the resulting manifold, much less how to do so without incurring extra steps for securing the baffles once inserted, or without the need for machining separate slots in the tubular wall for insertion of the baffles.

SUMMARY OF THE INVENTION

The present invention concerns a baffle for use in a tubular header or manifold for heat exchangers of the type disclosed in U.S. application Ser. No. 08/842,041. That is, the manifold has a generally D-shaped manifold segment having a number of slots parallel to the manifold axis and separated by webs of metal, and also having at least one baffle each of which is positioned between adjacent slots, whereby a hollow, flat tube is inserted into each slot and secured by joining along the peripheral surface of contact with the slot by such methods as soldering, brazing, welding or epoxying, and the manifold segment is divided into compartments by the baffles.

A manifold segment with a number of slots substantially as disclosed in U.S. application Ser. No. 08/842,041 forms the end chamber of a manifold for a heat exchanger. The slots are designed to accept flat tubes which also serve as spacers between the two manifolds of the heat exchanger, and are designed in particular to carry a heat exchanger fluid which flows through under high pressure. The fluid may be a liquid, a gas or a mixture thereof.

In the manifolds covered by the invention, the strength of the material in the transitional areas from the webs of metal between the slots to the cylindrical surface of the tube is increased by stamping each side of each web with a stamping die. Furthermore, by the use of equally-spaced stampings at each web, the webs are depressed or flattened relative to the portions of the manifold beyond the webs (that is, the webs have a radius of curvature substantially greater than that of the portions of the manifold beyond the webs) such that the cross-section of the manifold segment has an approximately D-shaped profile. The stampings strengthen the webs, in particular, in their transition to the cylindrical surface of the tube. The stampings used to strengthen each web are preferentially stamped symmetrically on each side of the web in the outside quarters of the web which are furthest from the web centerline.

The two stamped areas on both sides of the web are preferably positioned symmetrically on each side of the web in the outside quarters of the web which are furthest from the web centerline. The stampings are presented as depressions in the surface and vary with respect to height, width, depth and shape. The stamping and the resulting depression of the surface causes the top half of the originally cylindrical surface of the manifold to become more or less flat. The equally spaced stampings, which are made parallel to the longitudinal axis of the manifold segment, cause the webs of metal formed by the upper half of the manifold to be depressed in the direction of the tube axis.

The manifold in accordance with the present invention differs from the manifold disclosed in U.S. application Ser. No. 08/842,041 in two features. First, one end of the manifold is chamfered at an angle of approximately 45° in order to make insertion of a baffle into the manifold easier. Second, the other end of the manifold has a small notch therein for engagement with a support, to ensure consistent alignment of the manifold as the baffles are inserted and the slots and stampings are formed.

Each baffle is configured to have a profile substantially corresponding to the finished interior transverse cross-section of the manifold; specifically, each baffle is configured as a truncated circle, that is, a circle cut off along one side to have a slightly concave edge with a radius substantially greater than the rest of the baffle perimeter, giving the baffle an approximately D-shape. The baffle thus appears to have two edges, a principle or main circular edge and a truncated edge.

There are four different radii associated with the baffle's D-shape. The first radius, $R_1$, is the radius of the perimeter of the baffle the main circular edge of the baffle. The second radius, $R_2$, is the radius of the perimeter of the baffle at the truncated edge, which is greater than $R_1$. The third radius, $R_3$, is the transitional radius of the perimeter of the baffle between the first and second radii $R_1$ and $R_2$, which is substantially smaller than $R_1$ and $R_2$. The fourth radius, $R_4$, is a reverse radius in the perimeter of the baffle, inset from the transitional third radius $R_3$. The fourth radius, $R_4$, is positioned to register with the stampings in the webs, and is approximately the same as $R_1$.

A lip is formed along the remaining circular edge of the baffle, the lip having a sufficient width to support the baffle on its edge without tipping over when the baffle is inserted into the manifold, with the slightly concave edge oriented upward, facing the surface of the manifold in which the tube slots are to be formed. A projection extends outwardly from the perimeter of the baffle at either end of the lip, to provide an interference fit between the baffle and the interior surface of the manifold. The projection has an outer edge parallel to that of the main circular edge, and thus the perimater of the baffle has a fifth radius $R_5$ at the projection, the radius $R_5$ being slightly larger than the radius $R_1$. The interference fit between the projections and the manifold, in conjunction with the lip, maintain the baffle in its intended position, enabling the mandrel to be removed prior to stamping of the webs.

As disclosed in U.S. application Ser. No. 08/842,041, the baffles are configured to provide a slight gap between their upper edge (i.e., the concave edge) and the inner surface of the manifold, to accommodate the depressions in the inner surface of the manifold caused by the stampings. This gap is sufficiently small that it can be filled by a fillet of filler or bonding material during joining of the assembly.

The method used to manufacture a manifold for a heat exchanger as covered by the invention is as follows:

The metal manifold is supported on the outside along its length with a form-locking clamp, with the notch in the manifold end being engaged with a mating projection of the clamp. The baffles are inserted into the manifold segment one at a time using a mandrel. The mandrel is withdrawn from the manifold after the insertion of each baffle. As disclosed in U.S. application Ser. No. 08/842,041, equally spaced slots are then pierced and formed out in the tube perpendicular to the tube axis such that a web is formed between adjacent slots. Following this, two areas are stamped towards the outside of each web and equidistant to the centerline of the web such that the webs are depressed and the cross-section of the manifold segment now forms an approximately D-shape profile.

In order to make it easier to achieve the required approximately D-shaped profile, the webs can be depressed or flattened down in the direction of the tube axis by applying pressure before stamping is done.

BRIEF DESCRIPTION OF THE DRAWINGS

The present invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
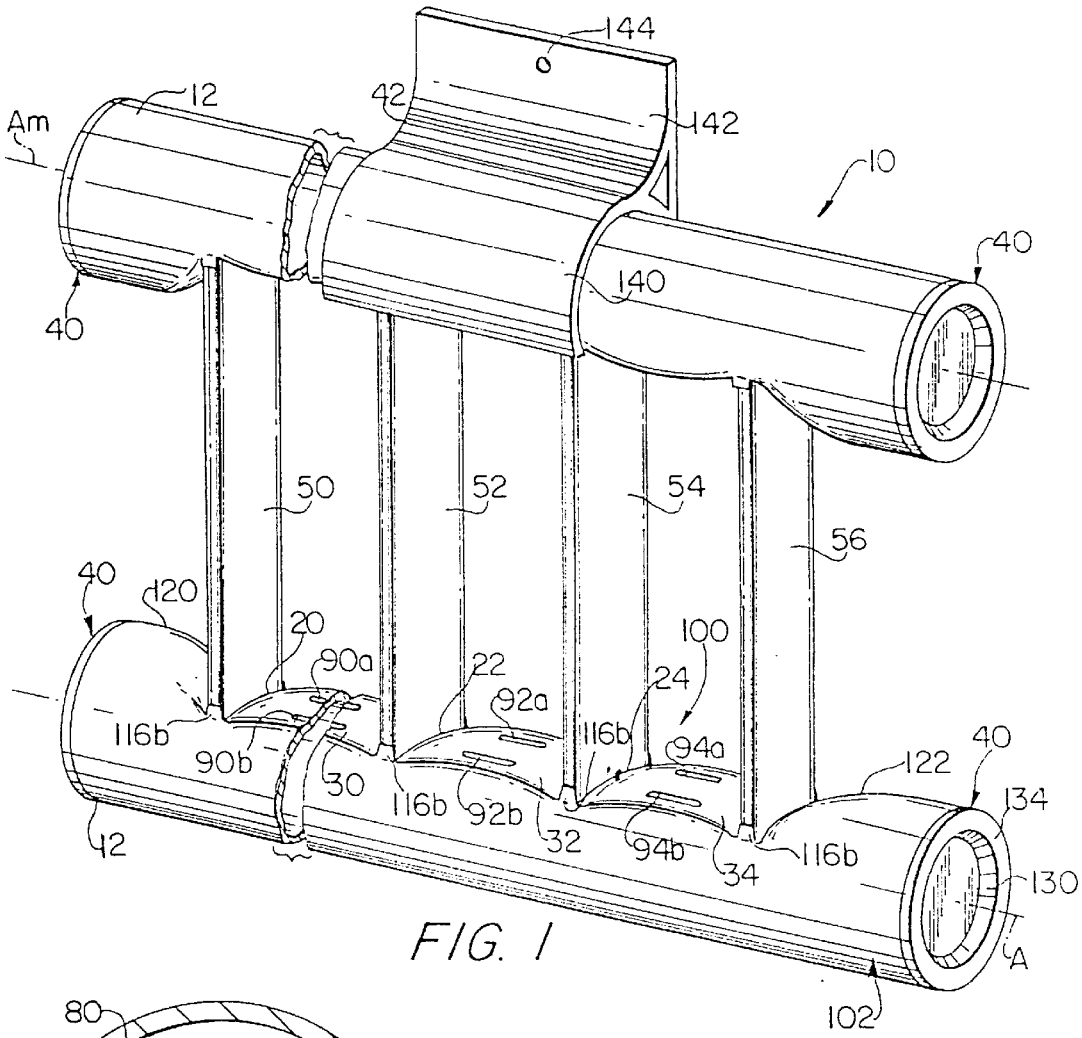
FIG. 1 is a perspective view of a heat exchanger with two manifolds in accordance with the present invention, with the conventional separators between the tubes omitted for the sake of clarity.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

FIG. 1 shows a perspective view of a heat exchanger with two manifolds 12 embodying the teachings of the present invention. The two manifolds 12 are substantially identical and are spaced apart and essentially parallel to each other. Preferentially, the manifolds 12 are made from aluminum or from a light alloy containing aluminum, copper or brass.

Each manifold 12 has a longitudinal axis $A_m$ and a manifold segment 14 which has a common longitudinal axis $A_m$ with the manifold 12. The manifold segment 14 has slots 20, 22, 24, and 26, which are perpendicular to the axis $A_m$ and are separated from each other by webs 30, 32, and 34. Although only four slots 20, 22, 24, and 26 are shown in the drawings for the sake of clarity, as will be appreciated by those of skill in the art, ordinarily the manifold segment 14 will have many more slots, depending upon the specific application for which the heat exchanger 10 is to be used.

The open ends of the manifolds 12 are closed by substantially identical end caps 40. Brackets 42 can be provided on manifolds 12 to hold the heat exchanger 10 in position.

The slots 20, 22, 24, and 26 in the manifold segment 14 of one manifold 12 are arranged to be opposite the corresponding slots in the manifold segment 14 of the other manifold 12. Hollow, flattened tubes 50, 52, 54, and 56 are inserted between the manifolds 12 in the respective slots 20, 22, 24, and 26. The flattened tubes 50, 52, 54, and 56 inserted in the manifold 12 are joined to the contact surfaces 60, 62, 64, and 66 of the slots 20, 22, 24, and 26 (see FIG. 10), respectively by such methods as soldering, brazing, wielding or epoxying.

Prior to piercing and forming out of the slots 20, 22, 24, and 26, at least one baffle 70 is inserted into at least one of the manifolds 12 in pre-determined positions. Preferably, each baffle 70 is made from a material similar to that of the manifolds 12.

Figure 16:
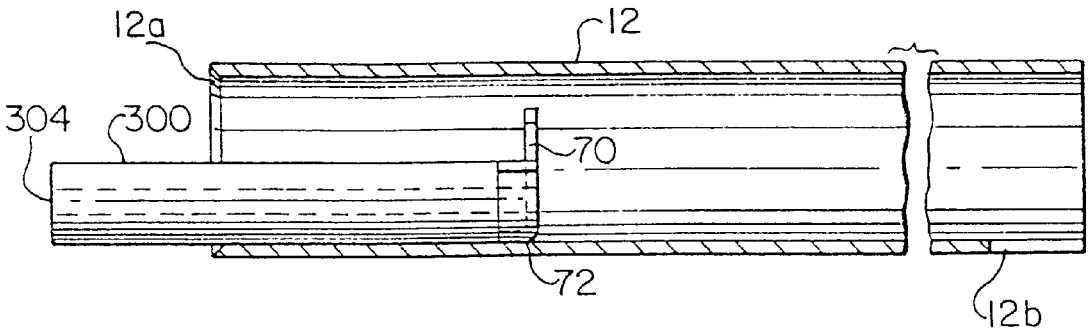
FIG. 16 is side cross-sectional view of a mandrel with a baffle positioned thereon, inserted into a manifold.

The manifolds 12 in accordance with the present invention differ from the manifold disclosed in U.S. application Ser. No. 08/842,041 in two features. First, one end of each manifold 12 is chamfered as indicated as 12*a* (shown in FIG. 16) at an angle of approximately 45° in order to make insertion of a baffle 70 into the manifold 12 easier. Second, the other end of each manifold 12 has a small notch 12*b* therein (also shown in FIG. 16) for engagement with a projection on a support (not shown), to ensure consistent alignment of the manifold 12 as the baffles 70 are inserted and the slots 20, 22, 24, and 26 and stampings 90*a* and 90*b*, 92*a* and 92*b*, and 94*a* and 94*b* are formed, as discussed hereinafter.

Figure 2:
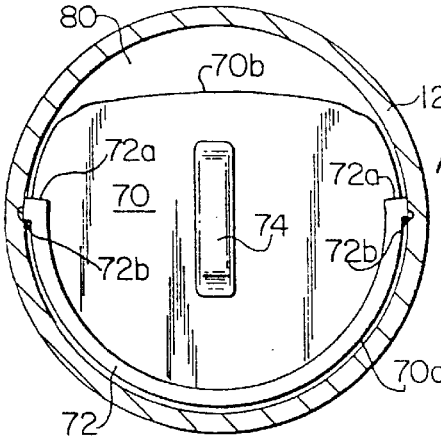
FIG. 2 is a cross-sectional view of a manifold having a baffle inserted therein, prior to formation of the tube slots.
Figure 3:
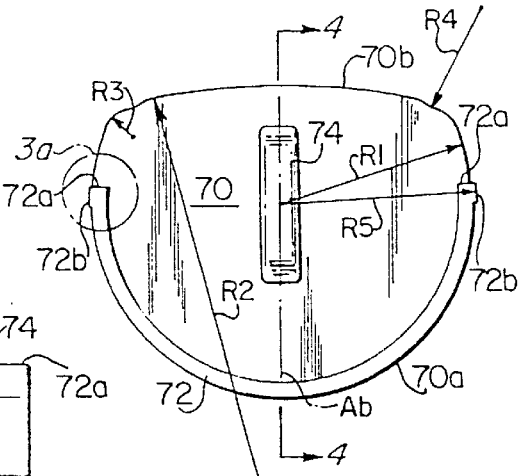
FIG. 3 is an end view of the baffle shown in FIG. 2.
Figure 4:
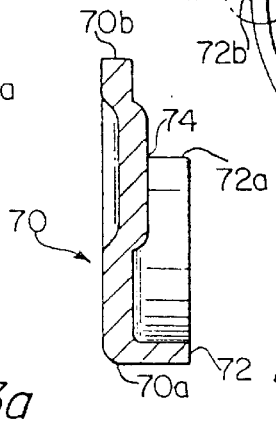
FIG. 4 is a cross-sectional view taken along line 4–4 of FIG. 3.

FIG. 2 is a cross-sectional view of a manifold 12 prior to stamping, having one such baffle 70 in position. As best shown in FIGS. 2, 3, and 4, each baffle 70 is configured as a truncated circle, that is, a circle cut off along one side to have a slightly concave edge, giving the baffle 70 an approximately D-shape. The baffle thus appears to have two edges, a principle or main circular edge 70*a* and a truncated edge 70*b*.

As shown in FIG. 4, there are four different radii associated with the baffle's D-shape. The first radius, $R_1$, is the radius of the perimeter of the baffle 70 at its main circular edge 70*a*. The second radius, $R_2$, is the radius of the perimeter of the baffle 70 at the truncated edge 70*b*, which is greater than $R_1$. The third radius, $R_3$, is the transitional radius of the perimeter of the baffle 70 between the main circular edge 70*a* and the truncated edge 70*b*, that is, between the first and second radii $R_1$ and $R_2$. The third radius, $R_3$, is substantially smaller than $R_1$ and $R_2$. The fourth radius, $R_4$, is a reverse radius in the perimeter of the baffle 70, inset from the transitional third radius $R_3$ The fourth radius $R_4$ is positioned to register with the stampings 90*a* and 90*b*, 92*a* and 92*b*, and 94*a* and 94*b* in the webs 30, 32, and 34, and is approximately the same as $R_1$. As will be appreciated by those of skill in the art, because there are two areas of transition between the the main circular edge 70*a* and the truncated edge 70*b*, that is, between the first and second radii $R_1$ and $R_2$, there are two areas on the perimeter of the baffle 70 having the third radius $R_3$ and two areas having the fourth radius, $R_4$.

Figure 3A:
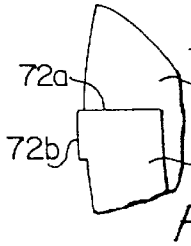
FIG. 3*a* is an enlargement of the area designated by a broken circle in FIG. 3.

A lip 72 is formed along a portion of the principle circular edge 70*a* of the baffle 70. Preferably, the ends 72*a* of the lip terminate at a line perpendicular to the baffle axis of symmetry $A_b$. The lip 72 has a sufficient width to support the baffle 70 on its edge without tipping over when the baffle 70 is inserted into the manifold 12, with the truncated edge 70*b* oriented upward, facing the inner surface of the manifold 12 in which the tube slots 20–26 are to be formed. A projection 72*b* extends outwardly from the perimeter of the baffle 70 at either end 72*a* of the lip 72, to provide an interference fit between the baffle 70 and the interior surface of the manifold segment 20. As best shown in FIG. 3*a*, the projection 72*b* has an outer edge parallel to that of the main circular edge 70*a*, and thus the perimeter of the baffle has a fifth radius $R_5$ at the projection 72*b*, the radius $R_5$ being slightly larger than the radius $R_1$. The interference fit between the projections 72 and the manifold segment 20, in conjunction with the lip 72, maintains the baffle 70 in its intended position without additional support prior to stamping of the webs.

The lip 72 also provides an increased bonding surface between the baffle 70 and the manifold 12. Each baffle 70 is positioned so that when the tube slots 20–26 are formed, the slightly concave edge of each baffle 70 is centered between two adjacent tube slots.

The external radius of the baffle 70 at its principle circular edge 70*a* must be slightly less than the inner radius of the manifold 12. Further, the width of the lip 72 must be sufficiently narrow to permit clearance for entry of the flattened tubes 50, 52, 54, and 56 through the tube slots 20, 22, 24, and 26, and the ends of the lip 72 must terminate below the ends of the tube slots 20, 22, 24, and 26

Exemplary dimensions for a baffle 70 in accordance with the present invention are set forth in the Table below:

| | Dimension (in cm) |
|---|---|
| $R_1$ | .9703 |
| $R_2$ | 2.1539 |
| $R_3$ | .1524 |
| $R_4$ | .9703 |
| $R_5$ | .9830 |
| Width of lip 72 | .4318 |
| Length of projection 72b | .0762 |

Each baffle 70 also is optionally provided with a locator dimple 74. The locator dimple 74 holds the baffle blank on the die during forming in conventional fashion, as will be understood by those of skill in the art, and also functions to orient the baffle 70 with respect to a mandrel during positioning of the baffle 70 in the manifold 12, as will be described in greater detail hereafter. This dimple 74 can be any shape which will necessitate proper alignment with a mating projection in the mandrel.

The surface of the lip 72 which contacts the inner surface of the manifold 12, and the surface of the baffle 70 which is contiguous therewith is clad with a material suitable for bonding the baffle 70 to the material of the manifold 12, for example by brazing, while the opposite surface of the baffle 70 may or may not be clad. As shown in FIG. 2, each baffle 70 is configured to provide a slight gap 76 between its upper edge (i.e., the concave edge) and the inner surface of the manifold 12, for ease of insertion and conformance to the final form of the manifold 12.

Figure 5:
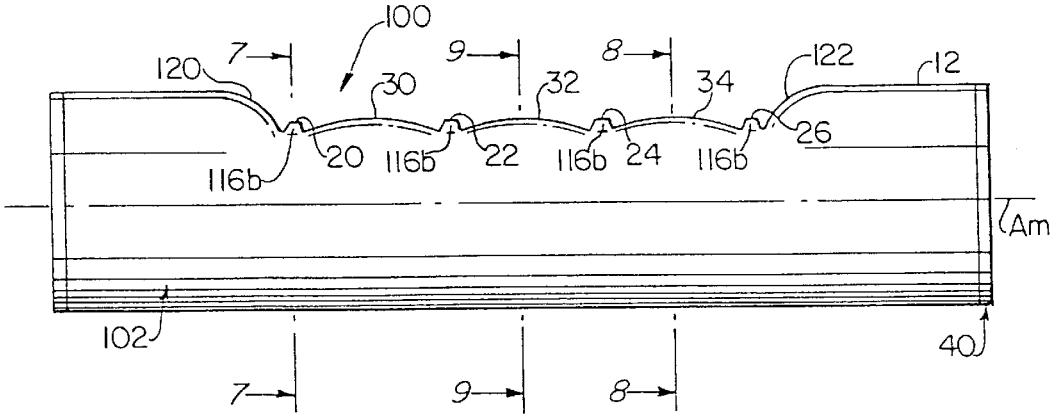
FIG. 5 is a side view of one of the manifolds shown in FIG. 1.

FIG. 5 is a side view of manifold 12 of heat exchanger 10 as covered by the invention. The manifold 12 of the heat exchanger 10 has a manifold segment 14 with slots 20, 22, 24, and 26 which are perpendicular to the manifold axis $A_m$ and spaced apart by the webs 30, 32, and 34.

Figure 6:
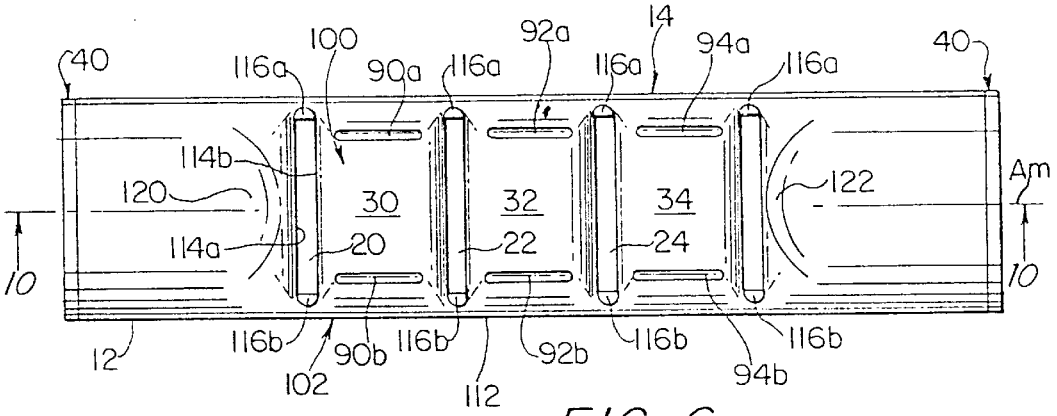
FIG. 6 is a plan view of the manifold segment of the manifold as shown in FIG. 1.

FIG. 6 is a plan view of manifold segment 14 of manifold 12 in which the webs 30, 32, and 34 between the slots 20, 22, 24, and 26 have stamped areas to strengthen the material. These stamped areas are parallel to manifold axis $A_m$, and are positioned on either side of a plane bisecting the slots 20, 22, 24, and 26 and intersecting the manifold axis $A_m$. The stamped areas are shown as the pairs of narrow stamped strips 90*a* and 90*b*, 92*a* and 92*b*, and 94*a* and 94*b*. The stamping and the resulting depression of the surface causes the top half 100 of the originally cylindrical surface of the manifold 12 to become relatively flat (i.e. to have a radius of curvature substantially larger than that of the rest of the manifold) throughout the manifold segment 14 in the direction of the manifold axis $A_m$, while leaving the side and lower surfaces 102 of the manifold segment in their original, substantially cylindrical form.

Although a circular cross-section is preferable from the perspective of overall strength, the generally D-shaped cross-section of the manifold segment 14 may be preferable because it is easier to form a joint between the manifold 14 and the heat exchanger tubes 52, 54, and 56 on a generally planar or relatively flattened surface, as found in the manifold segment 14, than around an arc as is found in a manifold of circular cross-section. Also, it is easier to assembly the heat exchanger tubes 52, 54, and 56 on a generally planar or relatively flattened surface than on an arc. However, if the webs 30, 32, and 34 are merely flattened, their strength is poor.

The narrow stamped strips 90*a* and 90*b*, 92*a* and 92*b*, and 94*a* and 94*b* strengthen the webs 30, 32, and 34 in the transition regions 110 and 112 from the relatively flattened surface 100 of the manifold segment 14 at the webs 30, 32, and 34 to the side and lower cylindrical surfaces 102 of the manifold segment 14. The stamped strips 90*a* and 90*b*, 92*a* and 92*b*, and 94*a* and 94*b*, which strengthen the material, are represented as depressions in the webs 30, 32, and 34. The depressed, stamped areas 90*a* and 90*b*, 92*a* and 92*b*, and 94*a* and 94*b* can also each be made as a stamped spot. The stamped areas can be preferentially made from a number of stamped spots which are spaced out along a straight line.

Figure 7:
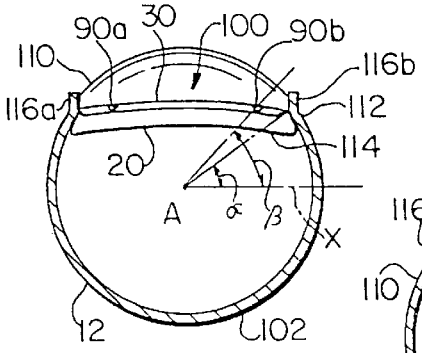
FIG. 7 is a cross-sectional view taken along line 7–7 of FIG. 5 which passes through one of the slots of the manifold segment of the manifold.

FIG. 7 shows a cross-sectional view of manifold 12 along line 7—7 through FIG. 5 through slot 20 of the manifold segment 14. Slot 20, as well as the other slots 22, 24, and 26, has flat transverse edges 114*a* and 114*b* which are folded over towards the inside of the manifold 12. Inwardly-folded edges 114*a* and 114*b* improve the contact surfaces 60, 62, 64, and 66 with the associated flat tubes 50, 52, 54, and 56 which are inserted into the slots 20, 22, 24, and 26.

The ends of each of slots 20, 22, 24, and 26 are spread out or enlarged upwardly and outwardly in a radial direction towards the respective sides of the web 30 to form curved lips 116*a* and 116*b* which also improve the strength of the transition regions 110 and 112 to the cylindrical surface 102 of the manifold segment 14. Due to the chosen length of the slots 20, 22, 24, and 26 in relation to the diameter of the manifold 12, a radius extending to the end of each of the slots 20, 22, 24, and 26 forms a slot end angle a on both sides of the manifold axis $A_m$ of preferentially 30° to the x-axis X of the cross-section (FIG. 7).

Figure 8:
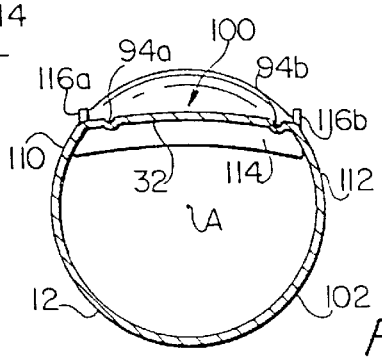
FIG. 8 is a cross-sectional view taken along line 8–8 of FIG. 5 which passes through one of the webs of the manifold segment of the manifold.

The pairs of stampings 90*a* and 90*b* shown in FIG. 7 and 92*a* and 92*b* shown in FIG. 8 are found on both sides of their respective webs 30 and 32 for strengthening the material. The pairs of stampings 90*a* and 90*b*, 92*a* and 92*b*, and 94*a* and 94*b* lie on radials on each side of the manifold 12. Each of the radials preferably has an angle β of approximately 60° to the x-axis X of the cross-section of the manifold 12. Stampings can also be positioned along a smaller radial angle β of e.g. 40° to 45° and thus, as contemplated by the invention, a radial angle β of preferentially 40° to 60° can be used when the slot end angle α is approximately 30°.

As discussed above, due to the pairs of stamped areas 90*a* and 90*b*, 92*a* and 92*b*, and 94*a* and 94*b* which are made simultaneously on the webs 30, 32, and 34 respectively, the original cylindrical shape of the manifold segment 14 at the webs 30, 32, and 34 now has a shortened and also flattened surface 100, which has been displaced radially towards the axis $A_m$ of the manifold 12.

According to the radial angle β at which the stamping die is applied to the surface of the manifold segment 14 at the start of stamping and the depth of the stamped areas 90*a* and 90*b*, 92*a* and 92*b*, and 94*a* and 94*b*, the webs 30, 32, and 34 between the pairs of stamped areas 90*a* and 90*b*, 92*a* and 92*b*, and 94*a* and 94*b* are more or less flattened, and thus the pairs of stamped areas on each side modify the upper, originally cylindrical shape of the outer surface of the manifold 12 to a more or less flattened surface 100 at each of the webs 30, 32, and 34.

Figure 9:
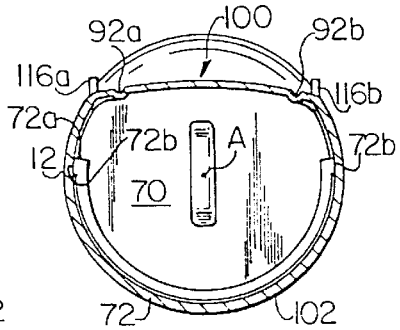
FIG. 9 is a cross-sectional view taken along line 9–9 of FIG. 5 which passes through another of the webs of the manifold segment of the manifold, and which shows a baffle.

FIG. 9 is a cross-sectional view through the line 8—-8 of FIG. 5 which passes through the center of the web 32 to show both the profile of the web 32 and the baffle 70 inserted at the center of the web 32 under the stamped areas 92*a* and 92*b*. The web 32 with the stamped areas 92*a* and 92*b* has a substantially D-shaped profile, as does the baffle 70, and the stamped areas 92*a* and 92*b* below which the baffle 70 is positioned engage the perimeter of the baffle 70 at the reverse radius $R_4$.

As shown in FIGS. 7 and 8, the straight edges 114 of the slot 20 which are folded towards the axis $A_m$ of the manifold 12 also form a D-shape together with the cylindrical surface 102 of the lower part of the manifold segment 14.

Figure 10:
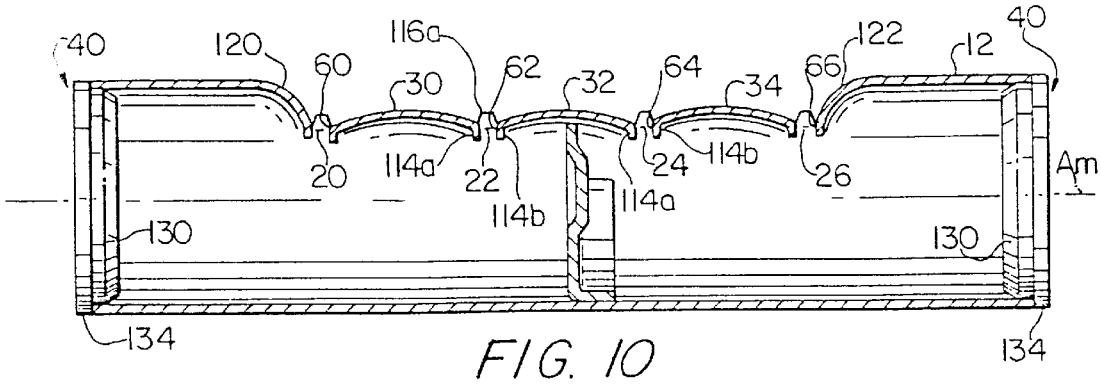
FIG. 10 is a longitudinal section along line 10–10 of FIG. 6 showing a manifold segment which is relatively flattened in the longitudinal direction.

FIG. 9 is a cross-sectional view through line 9—9 of FIG. 5 which passes through the center of the web 34 to show the baffle 70 inserted at the center of the web 34. The web 34 with the stamped areas 94*a* and 94*b* have a substantially D-shaped profile, as does the baffle 70. As can further be seen from FIG. 9. even after the web 34 has been relatively flattened, there remains a slight gap 80 between the baffle 70 and the inner surface of the manifold segment 14 to accommodate the depressions formed by the stamped areas 94*a* and 94*b*. This gap 80 is sufficiently small that it can be filled by a fillet of filler or bonding material during joining of all components of the heat exchanger 10 in a conventional joining process such as brazing. As shown in FIG. 10, the gap 80 also is sufficiently small that its truncated edge extends above the flat edges 114 of slots 20, 22, 24, and 26, which are discussed below in connection with FIG. 7.

FIG. 10 is a longitudinal section of the manifold 12 along the line 10—10 of FIG. 6. As shown in FIG. 10, the relatively flattened surface 100 of the manifold segment 14 is bounded at both ends by axially-sloping transition regions 120 and 122. The transition regions 120 and 122 start from the outer cylindrical surface of the manifold 12 and progress to the relatively flattened region 100 of the manifold segment 14, the relative flatness of which is only affected slightly by the slight doming of the webs 30, 32, and 34 between the slots 20, 22, 24, and 26. Accordingly, the manifold segment 14 represent a strong and relatively flat depression of the manifold 12.

The two regions web/slot/web and web/slot/transition have a funnel shape which allows the flat tubes 50, 52, 54, and 56 to be inserted more easily without tilting.

Each slot 20, 22, 24, or 26 has a pair of slot edges 114 along the length of the slot which edges are essentially parallel to each other and folded towards the inside of the tube to form peripheral contact surfaces 60, 62, 64, and 66 which represent easily joinable surfaces when in contact with the outer surface of each of the flat tubes 50, 52, 54, and 56 in FIG. 1.

The contact surfaces between the parallel slot edges 114, including the ends of the slots 20, 22, 24, and 26 and the associated peripheral surfaces on the outside of the flat tubes 50, 52, 54, and 56, mate with each other in such a way that they can be joined together with a filet of filler material around each tube which is largely on the same plane. Examples of filler material are solder, brazing alloy and epoxy.

To summarize, the slots 20, 22, 24, and 26 are preferentially made with flat edges on all sides to allow a continuous and easily joinable contact to the outside of the flat tubes 50, 52, 54, and 56 which are inserted.

Figure 11:
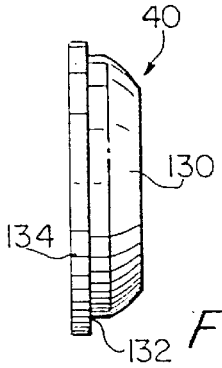
FIG. 11 is a side elevational view of an end cap of the heat exchanger shown in FIG. 1.
Figure 12:
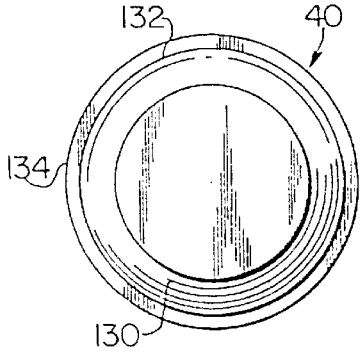
FIG. 12 is an end elevational view of the end cap shown in FIG. 10.
Figure 13:
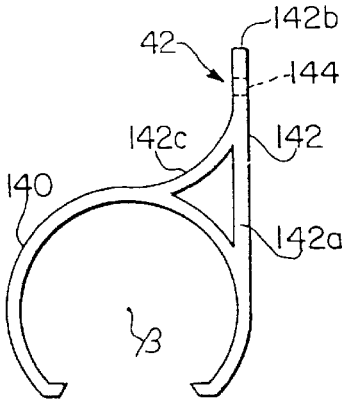
FIG. 13 is an end elevational view of a bracket of the heat exchanger shown in FIG. 1.
Figure 14:
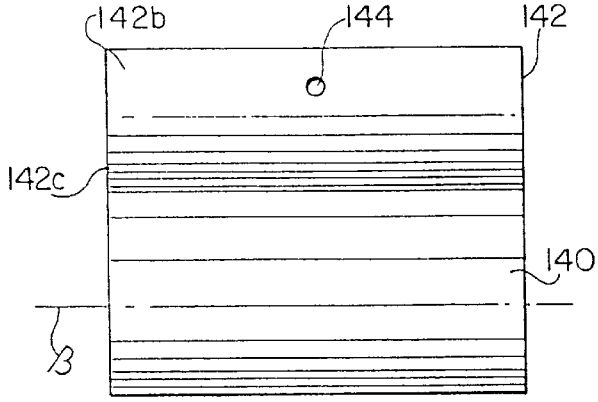
FIG. 14 is a side elevational view of the bracket shown in FIG. 12.

As mentioned above, the open ends of the manifolds 12 are closed by substantially identical end caps 40. As shown in FIGS. 11 and 12, each of the end caps 40 includes a cup-shaped portion 130 with a rim 132 and a flange 134 extending outwardly of the rim 132. As shown in FIGS. 1, 5, 6, and 9, the cup-shaped portion 130 is inserted into the interior of the manifold 12 at each of its ends, with the flange 134 abutting the end of the manifold 12. The outer diameter of the flange 134 is substantially equal to the outer diameter of the manifold 12 at its ends, while the inner diameter of the flange and the diameter of the cup-shaped portion 130 at the rim 132 is substantially equal to the inner diameter of the manifold 12 at its ends. The surface of the end caps 40 which is inserted into the interior of the manifold 12 is clad with a filler or bonding material such that the end caps 40 will become bonded to the manifold 12 during joining of all components of the heat exchanger 10 in a conventional joining process such as brazing As also mentioned above, brackets 42 can be provided on manifolds 12 to hold the heat exchanger 10 in position. As shown in FIGS. 13 and 14, each of the brackets 42 comprises a substantially C-shaped body portion 140 having an inner profile substantially corresponding to that of the outer cylindrical surface 102 of the manifold segment 14, for mating engagement therewith. The body portion 140 has a longitudinal axis B and a longitudinal plane of symmetry passing through the axis B. A substantially Y-shaped hanger portion 142 is formed integrally with the C-shaped portion 140, one arm 142*a* and the base 142*b* of the "Y" are co-planar, and extend tangent to the side of the body portion 140 parallel to its plane of symmetry. The other arm 142*c* of the "Y" forms a curved transition between the C-shaped portion 142 and the base of the "Y." At least one hole 144 is formed through the hanger portion 142 in the base 142*b* of the "Y" for receiving a fastener (not shown).

Preferably, the brackets 42 are formed by extrusion of a material suitable for bonding with the manifolds 12, the exterior surface of the manifolds 12 being clad with a bonding or filler material such that the brackets 42 will become bonded to the external surface of the manifold 12 during joining of all components of the heat exchanger 10 in a conventional joining process such as brazing. If the joining process requires a flux material, then the brackets 42 can be provided with longitudinal grooves 146 on the interior surface of the body portion 140, to allow wetting action of the flux material.

Figure 15:
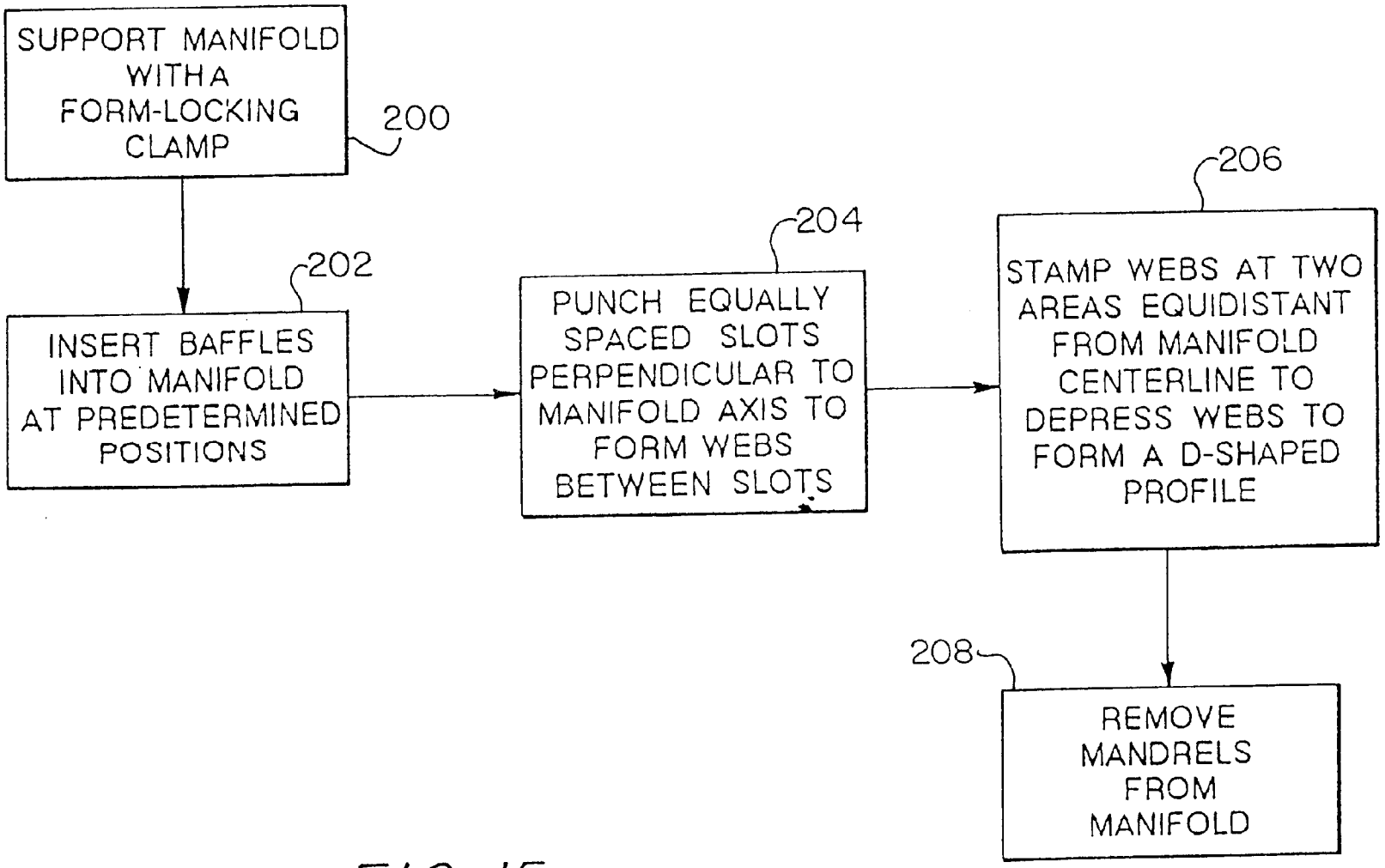
FIG. 15 is a flow chart showing the steps for making a manifold according to the teachings of the present invention.

The manufacture of the manifolds 12 as described in the invention with reference to FIG. 15 can take place according to the following method, which is also covered by the invention. As will be appreciated by those of skill in the art, due to the symmetry of the design, both manifolds 12 are manufactured in the same way.

Figure 17:
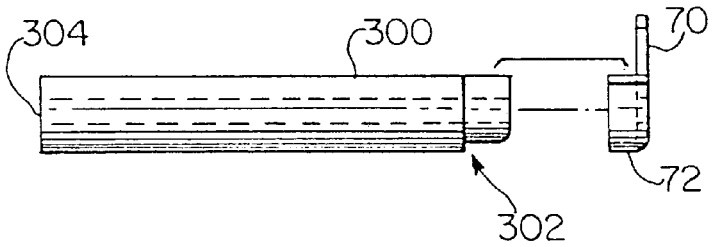
FIG. 17 is a side elevational view of a baffle being positioned on a mandrel for insertion into a manifold.
Figure 18:
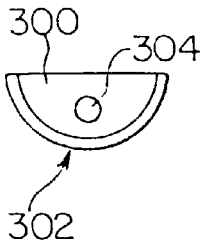
FIG. 18 is an end elevational view of a manifold showing the vacuum bore.

With reference to step 200, a metal manifold 12 preferentially made of aluminum is supported on the outside over its length by a form-locking clamp. Proper alignment of the manifold 12 in the clamp is ensured by the mating of the notch 12*b* with a projection on the clamp (not shown). According to step 202 and with reference to FIGS. 16–18, one or more baffles 70 are inserted through the chamfered end 12*a* into the manifold 12 at predetermined locations by means of a mandrel 300. The baffle 70 to be inserted is positioned against the mandrel 300, the mandrel 300 being machined out at the bottom as indicated at the numeral 302, in order to accommodate the lip 70, as best shown in FIG. 17. Also, the mandrel 300 may have a locator indentation for mating engagement with the locator dimple 74 of the baffle 70 as previously described. The mandrel 300 also has an axial bore 304 for applying a vacuum to the facing surface of the baffle 70, in order to better maintain the baffle 70 in place on the baffle during insertion into the manifold 12. Once the baffle 70 has been inserted into its predetermined location, the lip 72 and the projections 72*b* ensure that it will remain in place, permitting the mandrel 300 to be withdrawn for insertion of any succeeding baffles 70. The lip 72 and the projections 72*b* also ensure that the baffle 70 remains in the proper location during formation of the tube slots 20, 22, 24, and 26 and the stampings 90*a* and 90*b*, 92*a* and 92*b*, and 94*a* and 94*b*, as described below in connection with steps 204 and 206.

Following step 202, in step 204, slots 20, 22, 24, and 26 which are perpendicular to the longitudinal axis $A_m$ are pierced and formed out using a die to form the webs 30, 32, and 34, the slots 20, 22, 24, and 26 being positioned so that the baffles 70 are centered with respect to their respective webs. The apparatus and method for piercing and forming the slots 20, 22, 24, and 26 is conventional, and well-known to those of skill in the art.

Following placement of the baffles and formation of the slots in steps 202 and 204, in step 206, equally spaced pairs of stamped areas, 90*a* and 90*b*, 92*a* and 92*b*, and 94*a* and 94*b* are stamped in both halves of their respective webs 30, 32, and 34, parallel to the longitudinal axis $A_m$, to displace the originally cylindrical outer surface of the manifold segment 14 radially in the direction of the manifold axis $A_m$ and cause it to be depressed or relatively flattened, such that the cross-section of the manifold segment 14 largely has an approximately D-shaped profile.

Because the baffles 70 need not be supported after they are placed, as many baffles 70 as are required can be inserted into the manifold 12 prior to piercing and forming out the slots.

Preferably, a single press mechanism is used to pierce the slots 20, 22, 24, and 26 using a piercing die, form the edges 114 around the slots 20, 22, 24, and 26, and then form the pairs of stamped areas, 90*a* and 90*b*, 92*a* and 92*b*, and 94*a* and 94*b*, each of these operations being carried out in sequence by the press mechanism as described above.

The metal manifold 12 should be preferentially supported on the outside surface in a form locking-clamp, particularly in the vicinity of the ends of the slots 20, 22, 24, and 26. The pairs of depressed areas caused by the stamping 90*a* and 90*b*, 92*a* and 92*b*, and 94*a* and 94*b* and which strengthen the material are preferentially positioned in the outside quarters of the webs 30, 32, and 34. The outside quarters are positioned furthest from the web centerline.

In order to simplify achieving the required D-shape profile, the webs 30, 32, and 34 can be preferentially flattened with the use of pressure in the direction of the manifold axis $A_m$ before stamping the areas 90*a* and 90*b*, 92*a* and 92*b*, and 94*a* and 94*b*. The stamped areas, 90*a* and 90*b*, 92*a* and 92*b*, and 94*a* and 94*b* in the webs 30, 32, and 34 of the manifold segment 14 are preferentially made in a single stamping process.

The D-shaped cross-section of the manifold segment 14 ensures a rigid connection between the manifolds 12 and flat tubes 50, 52, 54, and 56. This rigid connection is strong enough to allow heat transfer fluid to flow through under high pressure. The invention and in particular the stamped areas 90*a* and 90*b*, 92*a* and 92*b*, and 94*a* and 94*b* ensure a considerable increase in the strength of the critical places in the transition regions 110 and 112 between the webs 30, 32, and 34 and the cylindrical surface 102 of the manifold segment 14. This has an advantageous affect on the durability of the heat exchanger 10.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A baffle for insertion into a tubular heat exchanger manifold segment having a finished interior transverse cross-section which is approximately D-shaped, said baffle having a principle circular edge and a truncated edge with a radius of curvature substantially greater than the rest of the baffle perimeter so as to have a truncated circular profile substantially corresponding to the finished interior transverse cross-section of the manifold segment, said baffle having an outwardly extending lip over a portion of its perimeter at said principle circular edge, wherein said lip has opposed ends and projections extending radially outwardly from said ends, said projections being dimensioned to provide an interference fit between said baffle and the manifold segment.

2. The baffle of claim 1, wherein said lip of said baffle has a sufficient width to support said baffle on its edge without tipping over when said baffle is inserted into the manifold segment.

3. The baffle of claim 1, wherein said baffle has an axis of symmetry and said ends of said lip terminate at a line perpendicular to said baffle axis of symmetry.

4. A manifold for a heat exchanger, said manifold being tubular in form and having two ends and a longitudinal axis and comprising:

an elongated manifold segment inset from said ends of said manifold, said manifold segment having an inner surface defining an interior and a longitudinal axis collinear with said longitudinal axis of said manifold, said manifold segment further having a plurality of parallel spaced slots formed therein, adjacent slots defining a web therebetween, each of said webs having at least two depressions extending into said interior of said manifold segment, said depressions being positioned on either side of a plane bisecting said slots and intersecting said manifold longitudinal axis, said manifold segment having a circular cross-section interrupted at said webs by a relatively flat profile so that said manifold segment and said inner surface thereof have an approximately D-shaped profile in transverse cross-section;

at least one baffle, said baffle having a principle circular edge and a truncated edge with a radius of curvature substantially greater than the rest of the baffle perimeter so as to have a truncated circular profile substantially corresponding to the transverse cross-section of the inner surface of the manifold segment, with a slight gap between at least a portion of the baffle perimeter and the inner surface of the manifold segment, said baffle having an outwardly extending lip over a portion of its perimeter at said principle circular edge, wherein said lip has opposed ends and projections extending radially outwardly from said ends, said projections being dimensioned to provide an interference fit between said baffle and the manifold segment, and said baffle perimeter is dimensioned to define a slight gap with said inner surface of said manifold segment except at said projections; and a fillet of filler material filling the gap between each of said baffles and said manifold segment.

5. The manifold of claim 4, wherein said lip of said baffle has a sufficient width to support said baffle on its edge without tipping over when said baffle is inserted into the manifold segment.

6. The manifold of claim 4, wherein said baffle has an axis of symmetry and said ends of said lip terminate at a line perpendicular to said baffle axis of symmetry.

7. A baffle having a principle circular edge and a truncated edge so as to have a truncated circular profile, wherein said principle circular edge has a first radius $R_1$, said truncated edge has a second radius $R_2$ greater than $R_1$, and said baffle has a third radius $R_3$, said third radius $R_3$ being a transitional radius between said first and second radii $R_1$ and $R_2$ and being substantially smaller than $R_1$ and $R_2$, and said baffle has a fourth radius $R_4$, said fourth radius $R_4$ being a reverse radius inset from said third radius $R_3$.

8. The baffle of claim 7, wherein said baffle has an outwardly extending lip over at least a portion of its perimeter at said principle circular edge.

9. A baffle having a principle circular edge and a truncated edge so as to have a truncated circular profile, wherein said principle circular edge has a first radius $R_1$, said truncated edge has a second radius $R_2$ greater than $R_1$, said baffle has a third radius $R_3$, said third radius $R_3$ being a transitional radius between said first and second radii $R_1$ and $R_2$ and being substantially smaller than $R_1$ and $R_2$, wherein said baffle has an outwardly extending lip over at least a portion of its perimeter at said principle circular edge, and wherein said lip has opposed ends and projections extending radially outwardly from said ends, said projections being dimensioned to provide an interference fit between said baffle and the manifold.

10. The baffle of claim 9, wherein said baffle has a fifth radius $R_5$ at said projections, $R_5$ being slightly larger than $R_1$.

11. The baffle of claim 9, wherein said baffle has an axis of symmetry and said ends of said lip terminate at a line perpendicular to said baffle axis of symmetry.

* * * * *